US005323877A

United States Patent [19]

Möri

[11] Patent Number: 5,323,877

[45] Date of Patent: Jun. 28, 1994

[54] DEVICE FOR THE TRIGGERING OF SAFETY EQUIPMENTS OF A LIFT PLANT

[75] Inventor: Peter Möri, Zug, Switzerland

[73] Assignee: Inventio AG, Hergiswil, Switzerland

[21] Appl. No.: 978,125

[22] Filed: Nov. 18, 1992

[30] Foreign Application Priority Data

Nov. 18, 1991 [CH] Switzerland ..... 3361/91

[51] Int. Cl.[5] ..... B66B 5/16

[52] U.S. Cl. ..... 187/91; 188/189

[58] Field of Search ..... 187/89, 90, 91, 38, 187/88; 188/188, 189, 43, 171

[56] References Cited

U.S. PATENT DOCUMENTS

| | | | |
|---|---|---|---|
| 3,441,107 | 4/1969 | Thorne et al. | 187/90 |
| 5,052,523 | 10/1991 | Ericson | 187/90 |
| 5,096,020 | 3/1992 | Korhonen | 187/88 |

FOREIGN PATENT DOCUMENTS

| | | |
|---|---|---|
| 0440839 | 8/1991 | European Pat. Off. . |
| 2826309 | 8/1979 | Fed. Rep. of Germany . |
| 87148609 | 12/1987 | Fed. Rep. of Germany . |
| 794510 | 2/1936 | France . |
| 369566 | 5/1963 | Switzerland . |

*Primary Examiner*—Kenneth W. Noland
*Attorney, Agent, or Firm*—Howard & Howard

[57] ABSTRACT

An apparatus is mounted on an elevator car for actuating a safety catch or a car brake when an excess car speed is detected in either a downward or an upward direction of travel, or when an unchecked movement of the elevator car takes place. The actuation takes place by movement of a pull rod cage connected to upper or lower pull rods, wherein the pull rod cage transmits a mechanical relative movement which is performed by a mechanical or an electromagnetic car speed monitoring device. Upper and lower sliding connections, which transmit tension forces and actuate the safety catch and the car brake respectively according to whether the car is moving downward or upwardly respectively, serve as connections between the pull rod cage and the upper and lower pull rods respectively.

15 Claims, 4 Drawing Sheets

DEVICE FOR THE TRIGGERING OF SAFETY EQUIPMENTS OF A LIFT PLANT

BACKGROUND OF THE INVENTION

The present invention relates generally to an elevator safety apparatus and, in particular, to an apparatus for actuating an elevator safety mechanism in response to excessive car speed.

A device for actuating a safety catch used in an elevator system is shown in the French patent specification no. 794 510 in which a lever linkage on the car triggers a safety catch when a control cable of a speed regulator breaks, when one or more car suspension cables extend or break, or when the elevator car is moving at an excessive speed during downward travel.

A device for actuating two safety catches, which are each arranged separately from the other, of a elevator car at the same time is shown in the German patent specification no. 28 26 309 in which a shaft has a triggering lever at both ends each of which is connected with a respective one of the safety catches engaging guide rails. The triggering levers are adjustably connected with the shaft so that an absolutely equal setting for actuating both of the safety catches can be achieved in the case of deployment.

A further device for the actuating of a safety catch in an elevator system is shown in the Swiss patent specification no. 369 566 in which an endless control cable connected with a car drives a regulator controlling a catching device of the car. The control cable is anchored to the car by way of a triggering device. The triggering device also triggers the catching device in the case of breakage of the control cable and the elevator car is brought to standstill, whereby serious accidents are prevented in advance.

A disadvantage of these known devices for the actuation of safety equipment in an elevator system lies in that they actuate safety equipment which brings the elevator car to a standstill only in the downward direction of travel when a car speed exceeds the normal speed by a certain amount, when a regulator cable breaks or when one or more car suspension cables extend or break.

SUMMARY OF THE INVENTION

The present invention concerns an apparatus for actuating an elevator safety mechanism such as a car brake and a safety catch. The invention is therefore based on the task of actuating an appropriate safety mechanism in the downward direction of travel as well in the upward direction of travel.

This problem is solved by the present invention in which a pull rod cage is mounted on an elevator car and is connected by lower pull rods with a safety catch and by upper pull rods with a car brake. In response to a car speed monitoring device which rotates a lever mechanism when excessive car speed is detected, the pull rod cage is moved to actuate either the safety catch or the car brake according to the direction of travel of the car.

The pull rod cage is connected to the upper pull rods and the lower pull rods by upper and lower sliding connections respectively. During excessive speed in a downward direction of travel, the lever mechanism moves the pull rod cage upwardly relative to the car thereby moving the lower pull rods and actuating the safety catch to stop the car. The pull rod cage also moves upwardly relative to the upper pull rods due to the upper sliding connection thereby preventing actuation of the car brake. During excessive speed in an upward direction of travel, the lever mechanism moves the pull rod cage downwardly relative to the car thereby moving the upper pull rods and actuating the car brake to stop the car. The pull rod cage also moves downwardly relative to the lower pull rods due to the lower sliding connection thereby preventing actuation of the safety catch.

The advantages achieved by the present invention are that substantially the same apparatus is usable for a mechanical as well as an electromagnetic car speed monitoring device and is usable independently of the direction of travel of the elevator car.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
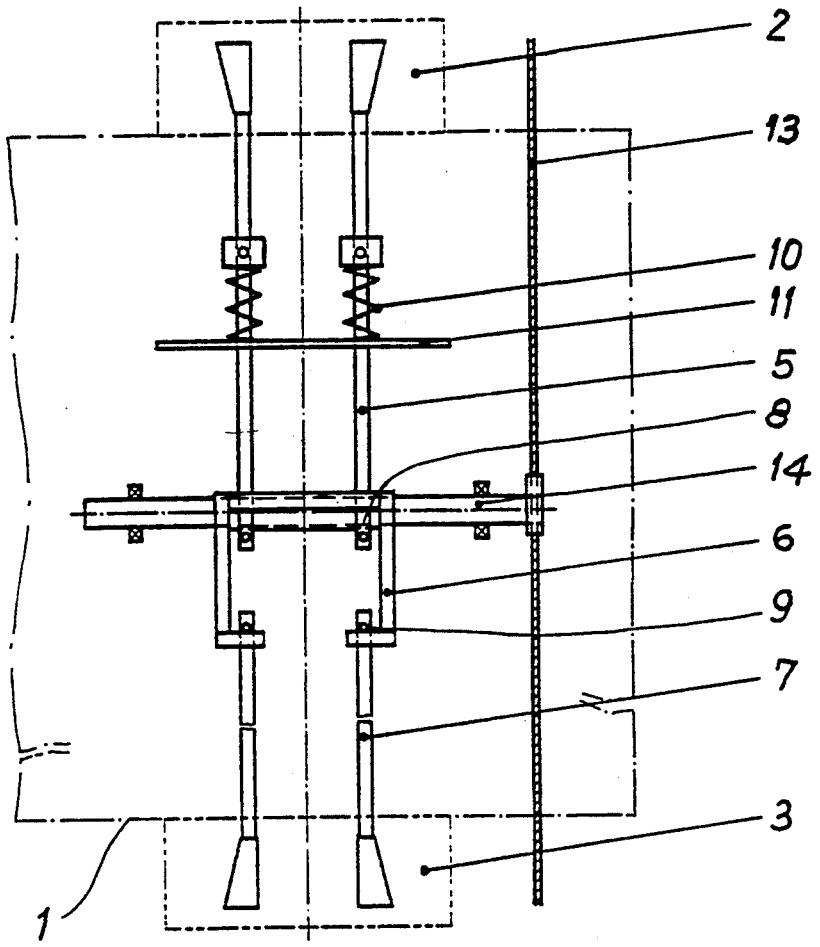
FIG. 1 is a front elevation view of the apparatus according to the present invention with a mechanical car speed monitoring device.
Figure 2:
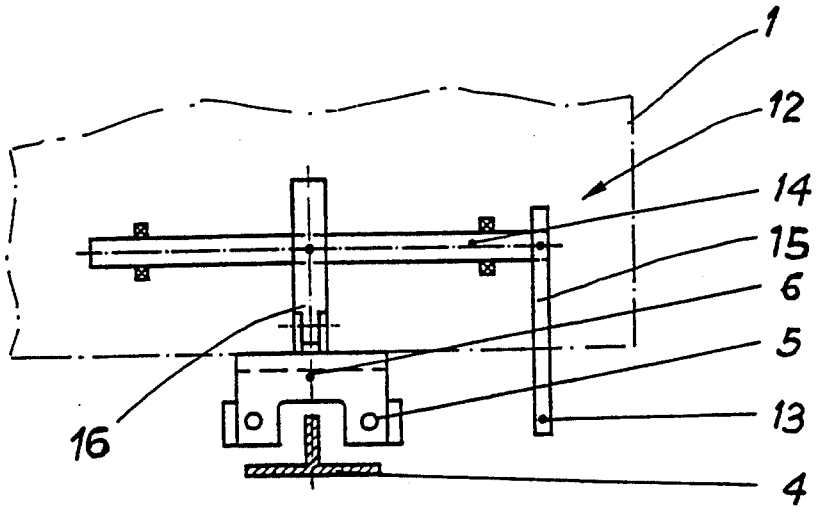
FIG. 2 is a top plan view of the apparatus shown in the FIG. 1.

A elevator car 1 is shown in the FIGS. 1 and 2 as having a car brake 2 positioned at the roof of the car for engaging a guide rail 4 and a safety catch 3 positioned at the floor of the car for engaging the guide rail 4. The car brake 2 is attached to upper ends of a pair of upper pull rods 5 which have lower ends coupled to a pull rod cage 6 through an upper sliding connection 8 for transmitting tension forces. The safety catch 3 is attached to lower ends of a pair of lower pull rods 7 which have upper ends coupled to the pull rod cage 6 through a lower sliding connection 9 for transmitting tension forces. Each of the sliding connections 8 and 9 is formed by a generally horizontally extending flange having a pair of apertures through which the ends of the corresponding pull rods pass and first stops attached to the ends of the pull rods to prevent the ends from passing back through the apertures. Thus, the flanges can slide along the pull rods between the stops and the opposite ends of the pull rods. In an initial position, the lower pull rods 7 stand upright supported on the safety catch 3 and the upper pull rods 5 are held in the initial position by the force of a pair of respective springs 10 which surround the pull rods and have upper ends which bear on second stops on the pull rods and lower ends which bear on a support bearing 11 firmly attached to the elevator car 1.

The pull rod cage 6 is suspended from the upper pull rods 5 and is connected by way of a lever mechanism 12 with a control cable 13 of an elevator speed regulator (not shown). The lever mechanism 12 includes a rotary axle 14 which is rotatably mounted on the elevator car 1, a first actuating lever 15 which has one end firmly attached at one end of the rotary axle 14 and an opposite end to which the control cable 13 of the speed regulator is firmly anchored, and a second actuating lever 16 which is firmly attached at one end at the center of the rotary axle 14 and has an opposite end articulated at the pull rod cage 16. The levers 15 and 16 cannot rotate relative to the axle 14.

Figure 3:
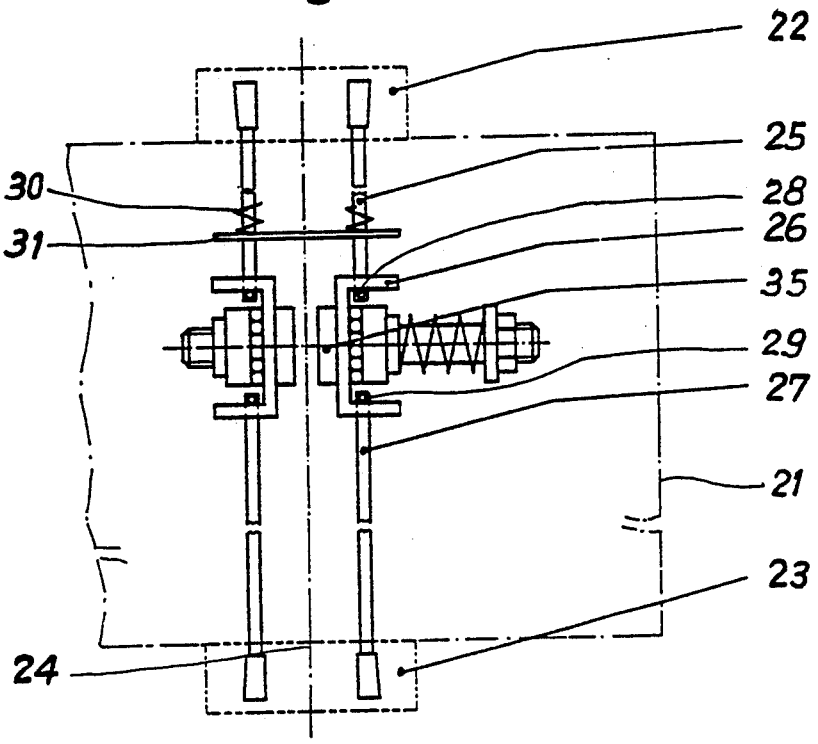
FIG. 3 is a front elevation view of the apparatus according to the present invention with an electromagnetic car speed monitoring device.
Figure 4:
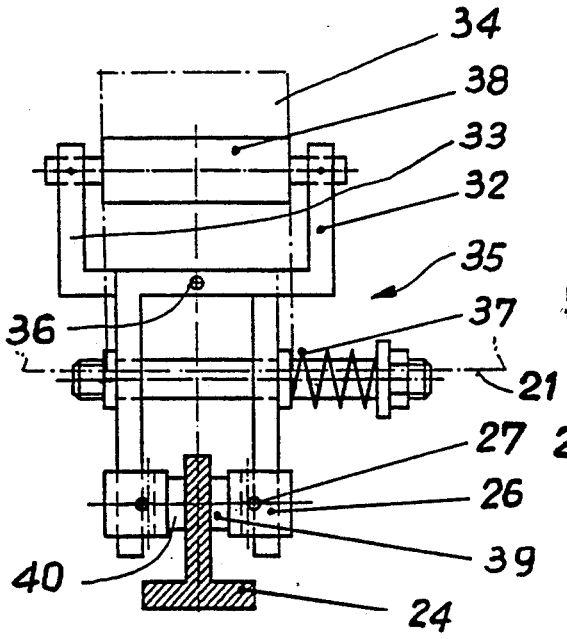
FIG. 4 is a top plan view of the apparatus shown in the FIG. 3 after the actuation of an elevator safety mechanism.
Figure 5:
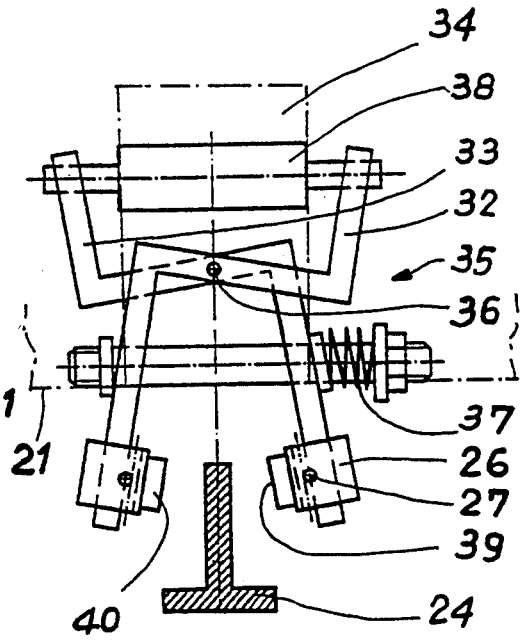
FIG. 5 is a top plan view of the apparatus shown in the FIG. 3 in a normal operating state.

An alternate embodiment of the present invention is utilized with an elevator car 21 shown in the FIGS. 3, 4 and 5. A car brake 22 for engaging a guide rail 24 is attached at the roof of the elevator car 21 and a safety catch 23 for engaging the guide rail 24 is attached at the floor of the car 21. The car brake 22 is attached to upper ends of a pair of upper pull rods 25 having lower ends coupled with a pull rod cage 26 through an upper sliding connection 28 for transmitting tension forces. The safety catch 23 is attached to lower ends of a pair of lower pull rods 27 having upper ends coupled with the pull rod cage 26 through a lower sliding connection 29 for transmitting tension forces. The lower pull rods 27 stand upright on the safety catch 23, while the upper pull rods 25 are held in an initial position by the force of a pair of respective springs 30 which surround the pull rods and have upper ends which bear on stops on the pull rods and lower ends which bear on a support bearing 31 firmly attached to the elevator car 21. The pull rod cage 26 is suspended by the upper pull rods 25, but is at the same time encompassed at opposite sides by respective brake levers 32 and 33 of an entraining brake 35 mounted on a frame 34 of the elevator car 21. The entraining brake 35 forms a lever mechanism which includes both of the brake levers 32 and 33 rotatably mounted on a pivot 36, at least one brake spring 37 and a brake magnet 38. Both of the brake levers 32 and 33 include a respective entraining plate 39 and 40 which lies against the guide rail 24 on one side and which in the case of use is urged by the force of the brake spring 37 against the guide rail 24.

Figure 6:
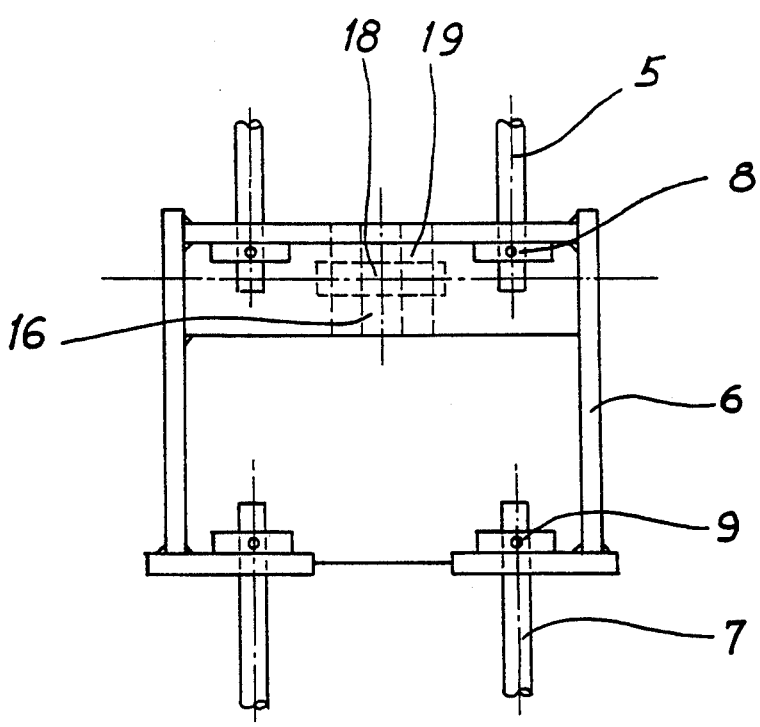
FIG. 6 is an enlarged fragmentary view of the sliding connection between the pull rod cage and the pull rods in the mechanical monitoring device shown in the FIG. 1.
Figure 7:
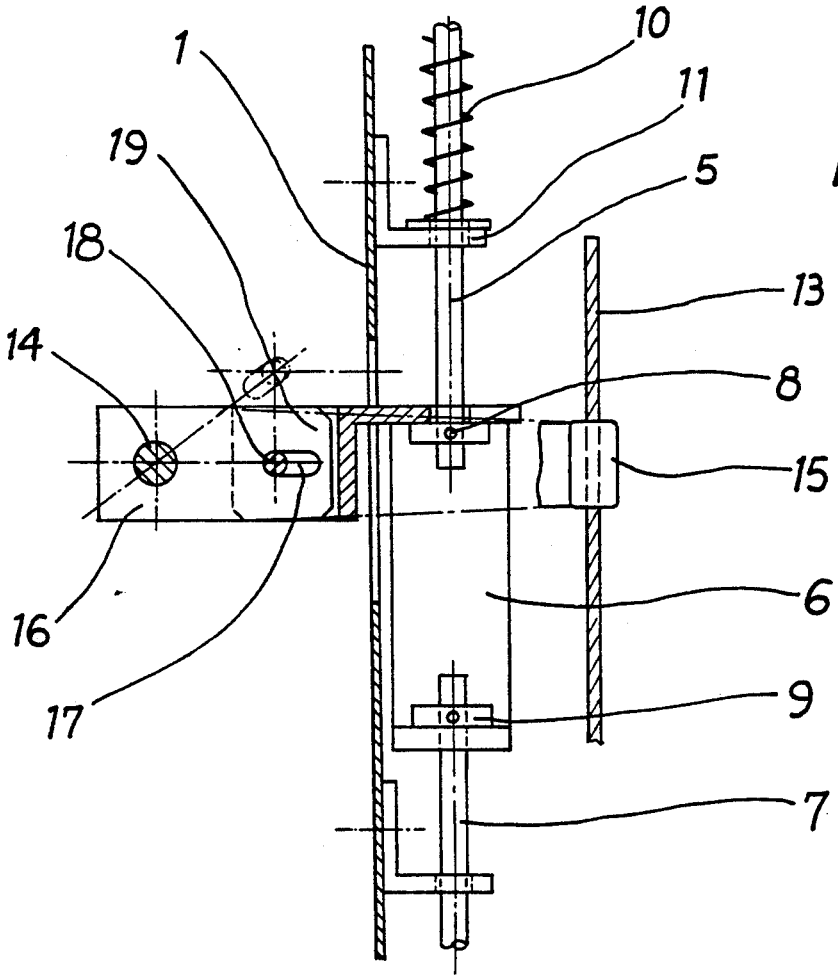
FIG. 7 is side elevation view of the sliding connection shown in the FIG. 6.

In the FIGS. 6 and 7, the pull rod cage 6 is coupled with the upper pull rods 5 by way of the upper sliding connection 8 and with the lower pull rods 7 by way of the lower sliding connection 9. The upper pull rods 5 are held in a rest position by the force of the springs 10 bearing on the support bearing 11. A hinge bearing 19 having a hinge pivot 18 is mounted on the rear side of the pull rod cage 6. The hinge pivot 18 is received in an elongated hole 17 formed in the second actuating lever 16 of the lever mechanism 12. The second actuating lever 16, together with the first actuating lever 15 to which the control cable 13 of the speed regulator is firmly anchored, are prevented from relative rotation with respect to the rotary axle 14 which is rotatably mounted on the elevator car 1.

Figure 8:
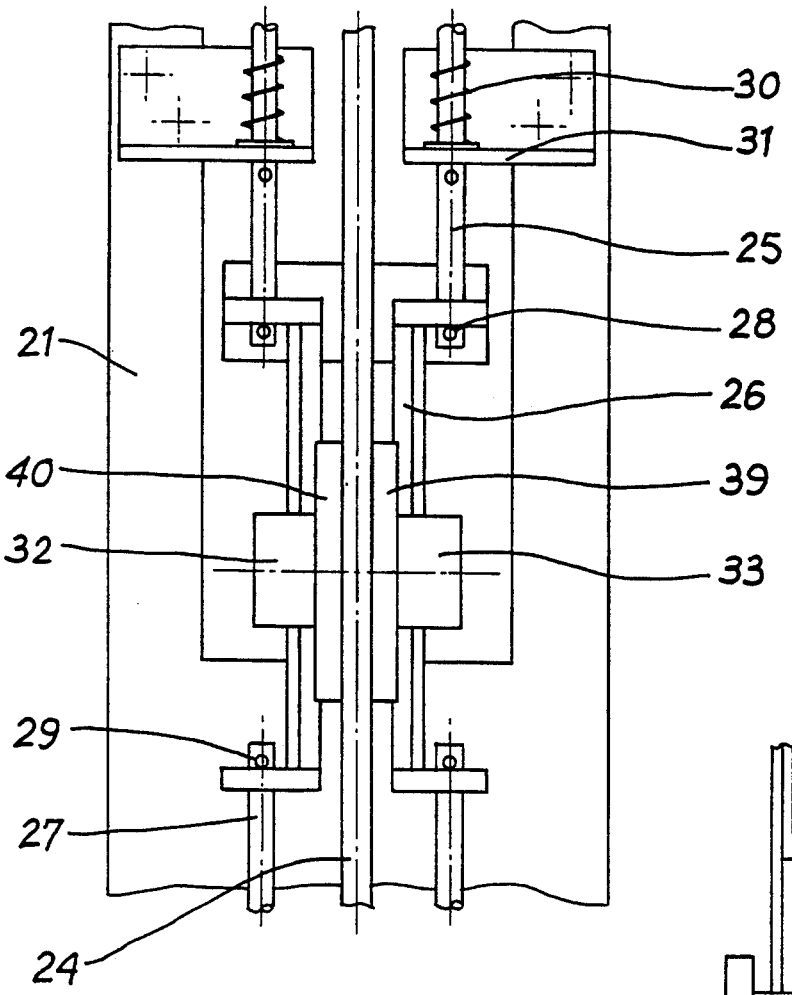
FIG. 8 is an enlarged fragmentary view of the sliding connection between the pull rod cage and the pull rods in the electromagnetic monitoring device shown in the FIG. 3.
Figure 9:
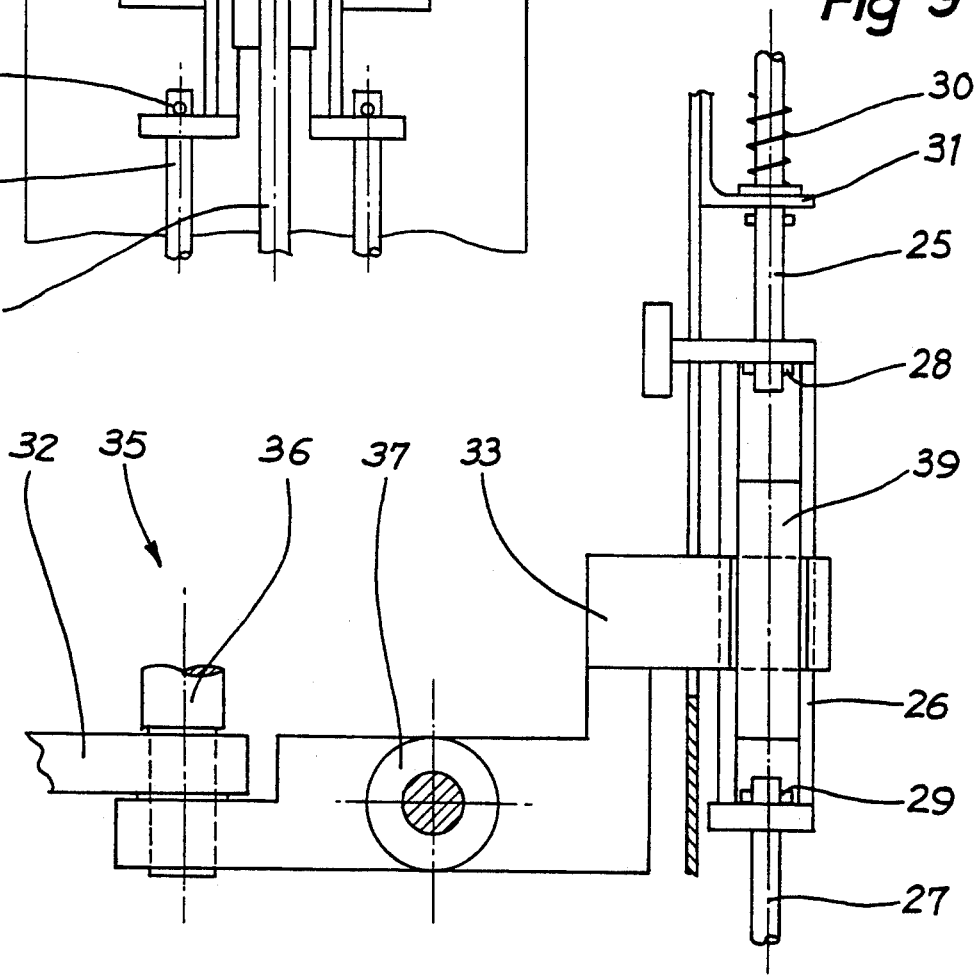
FIG. 9 is a side elevation view of the sliding connection shown in the FIG. 8.

In the FIGS. 8 and 9, the pull rod cage 26 is connected with the upper pull rods 25 by way of the upper sliding connection 28 and with the lower pull rods 27 by way of the lower sliding connection 29. The upper pull rods 25 are held in a rest position by the force of the springs 30 bearing on the support bearing 31. The lower pull rods 27 are held in an initial or rest position to stand upright on the safety catch 23. The pull rod cage 26 is suspended by the upper sliding connection 28 at the upper pull rods 25 and is encompassed on opposite sides by the respective brake levers 32 and 33 of the entraining brake 35. The brake levers 32 and 33 rotate about the rotary pivot 36 and are compressed by the force of the brake spring 37 or released by an electromagnet (not shown). When the brake levers 32 and 33 are urged together by the brake spring 37, the entraining plates 39 and 40 are urged against the guide rail 24.

The apparatus according to the present invention, which is illustrated in the FIGS. 1, 2, 6 and 7, for the actuation of a safety mechanism with the aid of a mechanical monitoring device operates as follows:

Upon the response of a speed regulator (not shown) in the case of downwardly directed excess speed of an elevator car, the control cable 13 firmly anchored to the first actuating lever 15 of the lever mechanism 12 is blocked against movement. Thereby, the first actuating lever 15 performs an upwardly directed relative movement, causing the second actuating lever 16 to likewise perform an upwardly directed rotary movement by way of the rotary axle 14 which is rotatably mounted on the car 1 and is secure against relative rotation with respect to both of the actuating levers 15 and 16. This rotary movement is transmitted by way of the elongated hole 17 to the hinge pivot 18 of the pull rod cage 6 and moves the pull rod cage 6 upwardly. During this upward movement, the lower pull rods 7 are likewise drawn upwardly by way of the lower sliding connection 9 and the safety catch 3 connected with the lower pull rods 7 is actuated thereby braking the elevator car to a standstill. The upper pull rod 5 maintains its rest position in that the pull rod cage 6 slides upwardly along the upper pull rods 5 on the upper sliding connection 8.

In the case of upwardly directed excess speed of the car 1, a downwardly directed relative movement takes place through the blocked control cable 13 and is transmitted appropriately to the pull rod cage 6 in the manner explained above. During the downward movement of the pull rod cage 6, the upper pull rod 5 is drawn by way of the upper sliding connection 8 downwardly against the force of the springs 10 and the car brake 2, connected with the upper pull rods 5, is actuated thereby braking the elevator car 1 to a standstill. The lower pull rods 7, due to their own weight, remain standing in their initial position on the safety catch 3, while the pull rod cage 6 slides downwardly along the lower pull rods 7 on the lower sliding connection 9.

An apparatus for actuating an elevator safety mechanism, which operates with the aid of an electromagnetic monitoring device, is illustrated in the FIGS. 3, 4, 5, 8 and 9. In the initial setting of the elevator, the armature of the current-free brake magnet 38 is pulled in. The biased brake spring 37 causes a contact pressure force on the guide rail 24 by way of the brake levers 33 and 34, the pull rod cage 26 and the entraining plates 39 and 40. Upon setting the elevator into operation, the brake magnet 38 is fed with current. The armature of the brake magnet 38 moves out and biases the brake spring 37 further by way of the brake levers 33 and 34. The entraining plates 39 and 40 lift off from the guide rail 24 and the elevator car is free to travel. In the case of a power failure, the de-energization of the brake magnet is delayed until the elevator car is at a standstill.

In the case of excess speed of travel of the elevator car 21, the current to the brake magnet 38 of the entraining brake 35 is interrupted. The biased brake spring 37 urges the pull rod cage 26 against the guide rail 24 by way of the entraining plates 39 and 40. According to the direction of travel of the elevator car 1, the pull rod cage 26 performs either an upwardly directed or a downwardly directed movement through the entraining plates 39 and 40 clamped fast against the guide rail 24. The further movements for the actuation of the safety catch 23 or of the car brake 22 take place by way of the pull rods 25 and 27 in a manner analogous to that of the aforedescribed mechanical monitoring device.

In the case of the mechanical car speed monitoring device as well as the electromagnetic car speed monitoring device, inserted brake wedges, which have become wedged between the guide rail and either the catch housing or the brake housing, must be released again after the actuation of the associated safety mechanism. For this purpose, the elevator car must be either raised or lowered in the direction respectively opposite to the direction of travel in which it was braked, which operation can be done from the location of the elevator driving machine.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for actuating a safety mechanism attached to an elevator car, the car having a car speed monitoring device for monitoring the movements of the car and for moving a lever mechanism mounted on the car in response to excessive car speed, comprising: a pull rod cage coupled to at least a lower pull rod attached to a safety catch mounted on an elevator car, said pull rod cage also being coupled to at least an upper pull rod attached to a car brake mounted on the elevator car, said pull rod cage being attached to send lever mechanism mounted on the car and moved by said car speed monitoring device mounted on the car in response to a detection of excessive car speed, a mechanical car speed monitoring device control cable attached to the lever mechanism for moving said pull rod cage upwardly and downwardly, and the lever mechanism including a rotary axle rotatably mounted on the car for transmitting relative movement to the pull rod cage, a first actuating lever and a second actuating lever each having one end attached to said axle for rotation therewith, said first actuating lever having an opposite end attached to said control cable and said second actuating lever having an opposite end articulated at said pull rod cage whereby when the elevator car moves downwardly at an excessive speed, said lower pull rod actuates the safety catch by an upwardly directed relative movement of said pull rod cage by the lever mechanism and, when the elevator car moves upwardly at an excessive speed, said upper pull rod actuates the car brake by a downwardly directed relative movement of said pull rod cage by the lever mechanism.

2. The apparatus according to claim 1 including a sliding connection coupling said lower pull rod to said pull rod cage for transmitting tension forces and wherein said lower pull rod stands upright in an initial position by its own weight on the safety catch.

3. The apparatus according to claim 1 including a sliding connection coupling said upper pull rod to said pull rod cage for transmitting tension forces, a support bearing attached to the car, and a spring extending between said support bearing and a stop on said upper pull rod for holding said upper pull rod in an initial rest position.

4. The apparatus according to claim 1 including a first sliding connection coupling said lower pull rod to said pull rod cage for transmitting tension forces and wherein said lower pull rod stands upright in an initial position by its own weight on the safety catch and including a second sliding connection coupling said upper pull rod to said pull rod cage for transmitting tension forces, a support bearing attached to the car, and a spring extending between said support bearing and a stop on said upper pull rod for holding said upper pull rod in an initial rest position.

5. An apparatus for actuating a safety mechanism attached to an elevator car, wherein a car speed monitoring device monitors the movements of the elevator car and is connected for moving a lever mechanism mounted on the car, comprising:

a pull rod cage;

a pair of lower pull rods having lower ends attached to a safety catch mounted on an elevator car and upper ends coupled to said pull rod cage;

a pair of upper pull rods having upper ends attached to a car brake mounted on the elevator car and lower ends coupled to said pull rod cage; and said lever mechanism moved by said car speed monitoring device in response to a detection of excessive car speed, said lever mechanism being connected to said pull rod cage whereby when the elevator car moves downwardly at an excessive speed, said lower pull rods actuate the safety catch by an upwardly directed relative movement of said pull rod cage by said lever mechanism and, when the elevator car moves upwardly at an excessive speed, said upper pull rods actuate the car brake by a downwardly directed relative movement of said pull rod cage by said lever mechanism.

6. The apparatus according to claim 5 including a first sliding connection coupling said lower pull rods to said pull rod cage for transmitting tension forces and wherein said lower pull rods stand upright in an initial position on the safety catch and including a second sliding connection coupling said upper pull rods to said pull rod cage for transmitting tension forces, a support bearing attached to the car, and a pair of springs extending between said support bearing and a stop on each of said upper pull rods for holding said upper pull rods in an initial position.

7. The apparatus according to claim 5 including a mechanical car speed monitoring device control cable attached to the lever mechanism for moving said pull rod cage upwardly and downwardly, the lever mechanism including a rotary axle rotatably mounted on the car for transmitting relative movement to the pull rod cage, a first actuating lever and a second actuating lever each having one end attached to said axle for rotation therewith, said first actuating lever having an opposite end attached to said control cable and said second actuating lever having an opposite end articulated at said pull rod cage.

8. The apparatus according to claim 5 wherein the lever mechanism includes a pair of brake levers in an electromagnetic car speed monitoring device entraining brake, said brake levers being connected to said pull rod cage and being actuated by the force of at least one brake spring and being released electromagnetically.

9. An apparatus for actuating a safety mechanism attached to an elevator car, wherein a car speed monitoring device monitors the movements of the elevator car and is connected for moving a lever mechanism mounted on the car, comprising:

a pull rod cage;

a pair of lower pull rods having lower ends attached to a safety catch mounted on an elevator car and having upper ends;

a lower sliding connection coupling said pull rod cage to said upper ends of said lower pull rods;

a pair of upper pull rods having upper ends attached to a car brake mounted on the elevator car and having lower ends;

an upper sliding connection coupling said pull rod cage to said lower ends of said upper pull rods; and said lever mechanism moved by said car speed monitoring device in response to a detection of excessive car speed, said lever mechanism being connected to said pull rod cage whereby when the elevator car moves downwardly at an excessive speed, said lower pull rods actuate the safety catch by an upwardly directed relative movement of said pull rod cage by said lever mechanism and, when the elevator car moves upwardly at an excessive speed, said upper pull rods actuate the car brake by a downwardly directed relative movement of said pull rod cage by said lever mechanism.

10. The apparatus according to claim 9 including a mechanical car speed monitoring device control cable attached to said lever mechanism for moving said rotary axle rotatably mounted on the car for transmitting relative movement to the pull rod cage, a first actuating lever and a second actuating lever each having one end attached to axle for rotation therewith, said first actuating lever having an opposite end attached to said control cable and said second actuating lever having an opposite end articulated at said pull rod cage.

11. The apparatus according to claim 9 wherein said lever mechanism includes a pair of brake levers in an electromagnetic car speed monitoring device entraining brake, said brake levers being connected to said pull rod cage and being actuated by the force of at least one brake spring and being released electromagnetically.

12. An apparatus for actuating a safety mechanism attached to an elevator car, the car having a car speed monitoring device for monitoring the movements of the car and for moving a lever mechanism mounted on the car in response to excessive car speed, comprising: a pull rod cage coupled to at least a lower pull rod attached to a safety catch mounted on an elevator car, said pull rod cage also being coupled to at least an upper pull rod attached to a car brake mounted on the elevator car, said pull rod cage being attached to said lever mechanism mounted on the car and moved by said car speed monitoring device mounted on the car in response to a detection of excessive car speed, and the lever mechanism including a pair of brake levers in an electromagnetic car speed monitoring device entraining brake, said brake levers being connected to said pull rod cage and being actuated by the force of at least one brake spring and being released electromagnetically whereby when the elevator car moves downwardly at an excessive speed, said lower pull rod actuates the safety catch by an upwardly directed relative movement of said pull rod cage by the lever mechanism and, when the elevator car moves upwardly at an excessive speed, said upper pull rod actuates the car brake by a downwardly directed relative movement of said pull rod cage by the lever mechanism.

13. The apparatus according to claim 12 including a sliding connection coupling said lower pull rod to said pull rod cage for transmitting tension forces and wherein said lower pull rod stands upright in an initial position by its own weight on the safety catch.

14. The apparatus according to claim 12 including a sliding connection coupling said upper pull rod to said pull rod cage for transmitting tension forces, a support bearing attached to the car, and a spring extending between said support bearing and a stop on said upper pull rod for holding said upper pull rod in an initial rest position.

15. The apparatus according to claim 12 including a first sliding connection coupling said lower pull rod to said pull rod cage for transmitting tension forces and wherein said lower pull rod stands upright in an initial position by its own weight on the safety catch and including a second sliding connection coupling said upper pull rod to said pull rod cage for transmitting tension forces, a support bearing attached to the car, and a spring extending between said support bearing and a stop on said upper pull rod for holding said upper pull rod in an initial rest position.

* * * * *